US007473213B1

(12) United States Patent
Kallenbach

(10) Patent No.: US 7,473,213 B1
(45) Date of Patent: Jan. 6, 2009

(54) WRIST SAVER EXERCISE HANDLE

(76) Inventor: Thomas G Kallenbach, P.O. Box 951186, Lake Mary, FL (US) 32795

( * ) Notice: Subject to any disclaimer, the term of this patent is extended or adjusted under 35 U.S.C. 154(b) by 621 days.

(21) Appl. No.: 10/944,942

(22) Filed: Sep. 20, 2004

(51) Int. Cl.
*A63B 21/00* (2006.01)
*A63B 21/062* (2006.01)
*A63B 21/055* (2006.01)

(52) U.S. Cl. ..... 482/139; 16/428; 16/430

(58) Field of Classification Search ..... 482/139, 482/24, 129, 92, 99, 101–103, 138; 16/422, 16/428, 430, 434, 445, 446, 900; 248/302; 294/137, 170, 171, 168, 167; 473/576; 441/69; D21/673, 679, 681, 684, 694, 777; 601/135
See application file for complete search history.

(56) References Cited

U.S. PATENT DOCUMENTS 134,527 A 1/1873 Eastman
740,443 A * 10/1903 Korth ..... 482/139
742,393 A * 10/1903 Chellis et al. ..... 482/50
760,374 A * 5/1904 Belvoir ..... 482/129
1,012,802 A * 12/1911 Brogan ..... 482/91
1,112,114 A * 9/1914 Caines ..... 482/129
1,123,570 A * 1/1915 Sandow ..... 482/124
1,717,861 A 6/1929 Washburn
1,729,399 A 9/1929 Noe
1,749,544 A 3/1930 Paqano
2,590,951 A 4/1952 Farison
3,873,088 A 3/1975 Panepinto
4,205,839 A * 6/1980 Best ..... 482/131
4,257,592 A * 3/1981 Jones ..... 482/131
4,627,618 A * 12/1986 Schwartz ..... 482/108
4,964,630 A * 10/1990 Curtiss ..... 482/50
5,033,740 A 7/1991 Schwartz et al.
5,234,394 A * 8/1993 Wilkinson ..... 482/92
5,377,984 A 1/1995 Ciccia
5,507,542 A * 4/1996 Eden ..... 294/143

(Continued)

FOREIGN PATENT DOCUMENTS

DE 3936443 A1 * 5/1991

(Continued)

OTHER PUBLICATIONS www.nefitco.com (bars and cable attachments).

*Primary Examiner*—Loan H Thanh
*Assistant Examiner*—Victor K Hwang
(74) *Attorney, Agent, or Firm*—Michael I. Kroll

(57) ABSTRACT

An ergonomic exercise handle having a semicircular arcuate member for connection to a resistive member and a handle grip having a longitudinal centerline that lies on the diameter of the semicircular arcuate member. A cable resistive member can be attached to the arcuate member with a conventional clip or with a special clip fitted with a small roller to reduce friction. The semicircular arcuate member permits the clip to move to a position in linear alignment with a center of the handle grip and the resistive member. Ends of the handle grip are spaced inwardly from ends of the semicircular arcuate member by circling back loop portions extending past the diameter of the arcuate member and inwardly from the arcuate member ends to the handle grip ends. The loop portions provide for a greater range of movement while still maintaining a center point of the arcuate member within the handle grip.

7 Claims, 8 Drawing Sheets

U.S. PATENT DOCUMENTS

| | | | | |
|---|---|---|---|---|
| 5,533,952 | A | 7/1996 | Schaber | |
| 5,556,369 | A * | 9/1996 | Roberts | 482/131 |
| 5,718,654 | A * | 2/1998 | Kennedy | 482/139 |
| 5,921,902 | A | 7/1999 | Carpenter | |
| 5,993,362 | A * | 11/1999 | Ghobadi | 482/124 |
| 6,558,302 | B2 * | 5/2003 | Cluff | 482/129 |
| 7,097,601 | B1 * | 8/2006 | Ronnow | 482/106 |
| 2003/0116982 | A1 | 6/2003 | Nicolay et al. | |
| 2003/0139264 | A1 | 7/2003 | Kuo | |
| 2004/0082448 | A1 * | 4/2004 | Martin | 482/139 |
| 2006/0030465 | A1 * | 2/2006 | Johnson et al. | 482/139 |

FOREIGN PATENT DOCUMENTS

| | | |
|---|---|---|
| GB | 2.339.153 | 1/2000 |

* cited by examiner

WRIST SAVER EXERCISE HANDLE

BACKGROUND OF THE INVENTION

1. Field of the Invention

The present invention relates generally to exercise equipment and, more specifically, to exercise equipment handles. The wrist is a complex joint and a common site for injury in virtually every type of athletic activity. Sports medicine studies have documented the wrist and hand as the most common sites for upper-extremity injuries in athletic activities. Compressive force, shear force and torque imposed on the wrist can result in acute and chronic injuries to skeletal and soft tissue structures of the joint.

Resistance type exercise equipment applies a force, which is biomechanically transmitted to the forearm by the user gripping a handle and extending, retracting or pivoting his arm. The wrist joint sustains all of these forces. The geometry of the handle, specifically the physical relationship of the location of the force connection point and the user's wrist as constrained by the handle, has a direct impact on how these forces effect the wrist joint.

Accordingly, there is a need in the art for a handle that would reduce the forces applied to the wrist and allow a free range of motion when using any type of existing mechanical resistance exercise machine. This handle would also correctly align the wrist and forearm preventing stress on the user's wrist joint and ligaments.

The present invention provides a device that applies the force of the exercise equipment as a radial load centered at the midpoint of the user's grip. The present invention also allows a free range of motion by allowing the user to adjust the flexion, extension, radial deviation and ulnar deviation of their wrist to keep the hand and forearm aligned in a neural position.

The preferred embodiment is an ergonomic exercise handle having an arc shaped frame for connection to a resistance, providing perfect wrist alignment. The uniqueness of the handle of the present invention is that the centerline of the handle grip lies on the diameter of the arcuate member. A cable is attached to the arcuate member with a conventional clip or with a special clip fitted with a small roller to reduce friction. The present invention provides exercise with motion similar to exercise using dumbbells and free weights, which allows the natural bend of the wrist.

2. Description of the Prior Art

There are other devices designed for exercise equipment handles. Typical of these is U.S. Pat. No. 134,527 issued to H. E. Eastman on Jan. 7, 1873.

Another patent was issued to C. Washburn on Jun. 18, 1929 as U.S. Pat. No. 1,717,861. Yet another U.S. Pat. No. 1,729,399 was issued to R. H. Roe on Sep. 24, 1929 and still yet another was issued on Mar. 4, 1930 to J. Pagano as U.S. Pat. No. 1,749,544.

Another patent was issued to S. Farison on Apr. 1, 1952 as U.S. Pat. No. 2,590,951. Yet another U.S. Pat. No. 3,873,088 was issued to Panepinto on Mar. 25, 1975. Another was issued to Leonard Schwartz et al. on Jul. 23, 1991 as U.S. Pat. No. 5,033,740 and still yet another was issued on Jan. 3, 1995 to Samuel J. Ciccia as U.S. Pat. No. 5,377,984.

Another patent was issued to Christopher R. Schaber on Jul. 9, 1996 as U.S. Pat. No. 5,533,952. Yet another U.S. Pat. No. 5,921,902 was issued to David Paul Carpenter on Jul. 13, 1999. Another was filed by Kenneth M. Nicolay et al. on Jun. 26, 2003 as U.S. Patent Application No. US2003/0116982. Another was filed on Jul. 24, 2003 by Hai Pin Kuo as Patent Application No. US2003/0139264A1 and another was issued to Steven Swatton on Jan. 19, 2000 as United Kingdom. Patent No. GB2339153.

U.S. Pat. No. 134,527

Inventor: H. E. Eastman

Issued: 7 Jan. 1873

The handles A provided with the hooks C, in combination with the elastics B, arranged substantially as set forth.

U.S. Pat. No. 1,717,861

Inventor: C. Washburn

Issued: 18 Jun. 1929

An exerciser of the character described, comprising a pair of handles and an elastic strip having a; plurality of holes in each end thereof, said handles each having a transverse bar, a plurality of pins, projecting from said bar, corresponding in size, number and spacing to the holes in said elastic strip, a cover plate hinged to said transverse bar, a latch therefor, and a filler plate holding said elastic strip flat against said transverse bar.

U.S. Pat. No. 1,729,399

Inventor: R. H. Roe

Issued: 24 Sep. 1929

An exerciser comprising a flat elastic band having an enlargement at one end which tapers from a thick extremity to the normal thickness of the band, a hand grip which comprises a handle bar and a head having a longitudinal slot which is cross sectionally tapering and which receives said enlarged end, and a wedge inserted in the slot with the enlarged end to compose an anchorage.

U.S. Pat. No. 1,749,544

Inventor: J. Pagano

Issued: 4 Mar. 1930

In an exercising apparatus, comprising handles and elastic straps; detachable connecting means, each comprising a hollow cylindrical member slotted longitudinally and secured to a handle, and an elongated link, of slightly greater length than said cylindrical member, secured to a strap end, said link having one side normally positioned within said member, the link member material being of greater diameter than the width of said slot, and one end of said link being flattened to a thickness less than said slot width, whereby said flattened end may be passed through said slot to detach said link from, and reengage same with, said member U.S. Pat. No. 2,590,951

Inventor: S. Farison

Issued: 1 Apr. 1952

An exerciser comprising elastic elements, an extensible jacket therefor to form an endless cylindrical bundle, a pair of tubular hand grips through which the bundle extends with the jacket spacing the elements from the grips, said grips being of general U-shape with a grasp enlargement at the cross over for the U-sufficient to centralize the band at grasping to be clear of the legs of the U, said legs being spaced to provide arm clearance to swing freely between reaches of the elastic body upon stretching thereof, one of said U-grips having its, elbow are connection to its cross over different in arc from the other elbow of said same grip, coacting thereby to differentiate between the tension action of the reaches upon stretching of the body to respond upon tension release for step by step lineal progress of the body through the respective grips in uniformly subjecting the body to wear action throughout its length.

U.S. Pat. No. 3,873,088

Inventor: Louis J. Panepinto

Issued: 25 Mar. 1975

In a chest pull type exerciser comprising a pair of handles interconnected by a plurality of elongated resilient elements, said handles having a base portion and a generally U-shaped hand grip connected thereto, said base portion having a row of transverse slots formed therein, a row of generally U-shaped removable resilient retainers overhanging the opposite ends of said slots on the side of said base portions facing said hand grips, means for connecting opposite ends of said elongated resilient elements to said retainers at the underside of said base portions, and means for further removably securing said retainers in said base portions comprising aligned eyelets formed on the overhanging ends of said retainers along at least one edge of said base portion sides facing said hand grips, and generally L-shaped elements having an elongated upright leg and a base leg which is relatively short with respect to said upright leg, said upright legs extending through said aligned eyelets and said base legs overlying said base portions at the junctures of said U-shaped hand grips with said base portions, detents on said hand grips overlying said base legs, and the endmost ones of said rows of retainers being positioned close to said detents so as to resiliently trap said base legs beneath said detents.

U.S. Pat. No. 5,033,740

Inventor: Leonard Schwartz et al.

Issued: 23 Jul. 1991

An apparatus for exercising. The apparatus comprises a first portion having a predetermined weight. The first portion is grippable by a hand and has a first end and a second end. The apparatus is also comprised of N second essentially rigid portions connected to the first portion such that the N openings are defined by the first portion and the N second portions where N.gtoreq.1. The N openings are each capable of receiving a hand in a manner that essentially does not affect blood pressure or blood circulation through the hand. The first portion is disposed with respect to the front of the hand and the second portion is disposed with respect to the back of the hand. An exerciser uses the apparatus by placing his hand through the opening and gripping the first portion. When, for instance, the exerciser swings his arm, the second portion that is disposed with respect to the back of the hand facilitates the exerciser maintaining a grip on the first portion without having to grip it tightly while moving the arm during exercise.

U.S. Pat. No. 5,377,984

Inventor: Samuel J. Ciccia

Issued: 3 Jan. 1995

A universal golf club grip comprising a substantially rectangular unit having a front, back, top, bottom and two side portions, said grip having a slotted conduit extending through its entire height and originating from, a top substantially central section of said top portion and terminating at said bottom portion, said conduit tapered from a larger top terminal opening to a smaller bottom terminal opening, said two side portions being configured to receive the palm of either a right or left hand, said bottom portion having finger grooves to receive the fingers of either a right or left hand.

U.S. Pat. No. 5,533,952

Inventor: Christopher R. Schaber

Issued: 9 Jul. 1996

An improved handgrip assembly for an exercise machine having a cord tension means, said handgrip assembly comprising: a generally D-shaped handle having a gripping portion and a curved non-gripping portion, said gripping portion having an axial bore for the reception of said cord means; means within said bore for anchoring an end of said cord means; and anchor means located on the curved portion which engages a length of said cord means, to effectively change the length of said cord means.

U.S. Pat. No. 5,921,902

Inventor: David P. Carpenter

Issued: 13 Jul. 1999

An adjustable handlebar is shown having a first handle attached to a first disc and a second handle. An aperture passing through the first disc and second handle pivotally joins the two. A second set of apertures passing through the first disc and second handle receive a detent pin to adjustably set the angle between first and second handles.

U.S. Patent Application 2003/0116982 A1

Inventor: Kenneth M. Nicolay et al.

Issued: 25 Jul. 2003

A handle is disclosed for tools such as shovels and the like. The handle includes first and second legs, each of which has a first end which is securable to a tool head such that the first and second legs extend outwardly from the tool head in generally parallel relation to one another. A handlebar is connected to second ends of the first and second legs. The handlebar is curved to accommodate a normal orientation of a user's wrists. A lower handle is slidably connected to said first and second legs so as to be moveable toward and away from the handlebar and pivotable between a retracted position and an operating position. In the operating position the lower handle extends outward from a plane defined by the first and second legs. A slide lock is provided for selectively securing the lower handle to the first and second legs.

U.S. Patent Application 2003/0139264 A1

Inventor: Hai Pin Kuo

Issued: 24 Jul. 2003

An exerciser includes a base, a control panel disposed on the base, a receiver device electrically coupled to the control panel, a handle, and a remote control device attached onto the handle, for allowing the remote control device to be operated by a hand of a user that holds the handle, and for allowing the remote control device to be easily operated by the users even when the users are actuating or operating the exercisers. The receiver device may be secured to various portions of the base. A seat may be supported on the base for supporting the user and the handle.

United Kingdom Patent GB2339153A

Inventor: Steven John Swatton

Issued: 19 Jan. 2000

A grip and forearm developer consists of two handles, handle 2 has two studs 3 welded vertically near to the ends which act as guides and spring retainers, the other handle 1 has two holes drilled to accommodate the two partially threaded studs 3 from the other handle 2, two washers 9 and a wire compression spring 4 slips over each stud 3, the whole device is then secured by two locking nuts 5. To operate the developer the handle 1 is gripped with the fingers and drawn back toward handle 2 which is positioned in the palm of the hand then release and repeat until it has the desired effect. The springs 4 maybe interchangeable to alter the force required to operate or to replace worn springs. While these inventions may be suitable for the purposes for which they were designed, they would not be as suitable for the purposes of the present invention, as hereinafter described.

SUMMARY OF THE PRESENT INVENTION

A primary object of the present invention is to provide ergonomic exercise handles.

Another object of the present invention is to provide an exercise handle having an arcuate member providing means for connecting some form of resistance whereby linear alignment exists between the center of the hand grip and the resistance.

Yet another object of the present invention is to provide a handle having an arcuate member providing means for attaching a slidable member thereon consisting of a conventional clip or with a special clip fitted with a small roller to reduce friction.

Still yet another object of the present invention is to provide natural alignment of the wrist and forearm.

Another object of the present invention is to provide a frame with the centerline of the handle grip lying on the diameter of the arcuate member.

Additional objects of the present invention will appear as the description proceeds.

The present invention overcomes the shortcomings of the prior art by providing an ergonomic handle that when connected to any form of resistance will allow free range of motion thus reducing stress on the wrist joint.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 7 is a view of the arcuate member of the present invention while FIGS. 7*a*-7*f* show alternate cross sectional shapes of the arcuate member.

FIG. 8 is a sectional view of an additional element of the present invention while FIG. 8A shows an alternative embodiment of the additional element.

DESCRIPTION OF THE REFERENCED NUMERALS

Figure 1A:
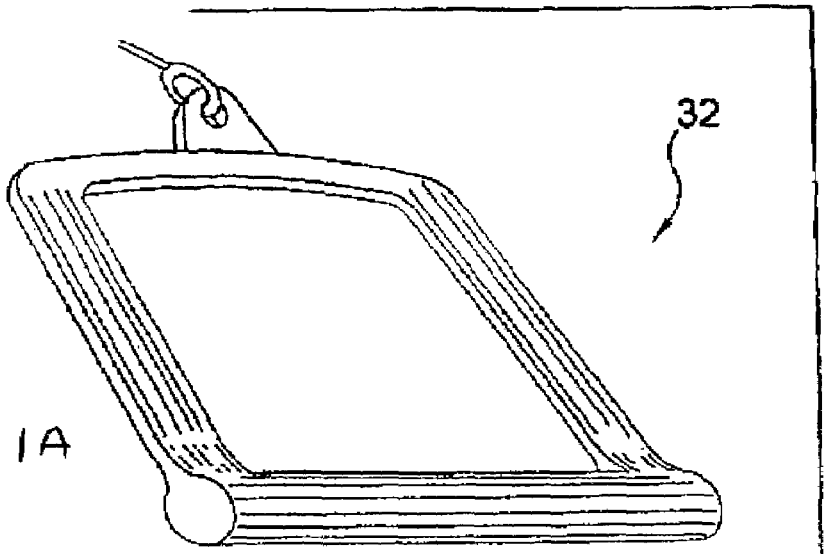
FIG. 1A PRIOR ART
FIGS. 1 and 1A show a comparison of prior art to the present invention.

Turning now descriptively to the drawings, in which similar reference characters denote similar elements throughout the several views, the figures illustrate the Ergonomic Handle for Resistance-Based Exercise Devices of the present invention. With regard to the reference numerals used, the following numbering is used throughout the various drawing figures.

| | |
|---|---|
| 10 | Ergonomic Handle for Resistance-Based Exercise Devices |
| 12 | arcuate member |
| 14 | first end of 12 |
| 16 | second end of 12 |
| 18 | slidable member |
| 20 | cable clip |
| 22 | hand grip |
| 24 | longitudinal center line of 22 |
| 26 | center of 22 |
| 28 | constant radius from 26 to arc of 12 |
| 30 | shaft |
| 32 | handle of the prior art |
| 34 | user |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
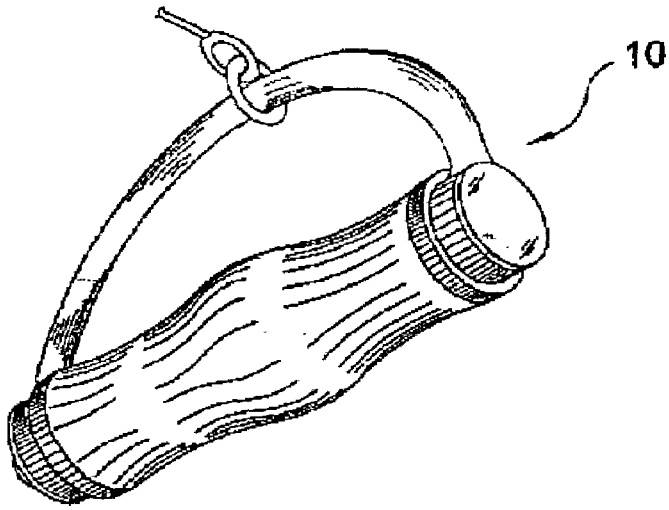

FIG. 1 is a comparison of prior art to the present invention. Shown is the prior art of the typical handle 32 connecting the resistance to the handle frame at a fixed point of attachment, fixing the handgrip at a particular angle, generally ninety degrees, to the line of resistance and the forearm. This is often not the natural angle the wrist prefers. Forcing the wrist to remain at this fixed unnatural angle throughout the exercise can be uncomfortable and even destructive to the wrist joint.

The present invention 10 has an arcuate member providing for a slidable member to achieve linear alignment between the center of the hand grip and some form of resistance allowing the hand-grip to easily and naturally assume a more comfortable, wrist-friendly position so the wrist can automatically adjust itself or keep its natural alignment with the forearm, significantly reducing stress and fatigue.

Figure 2:
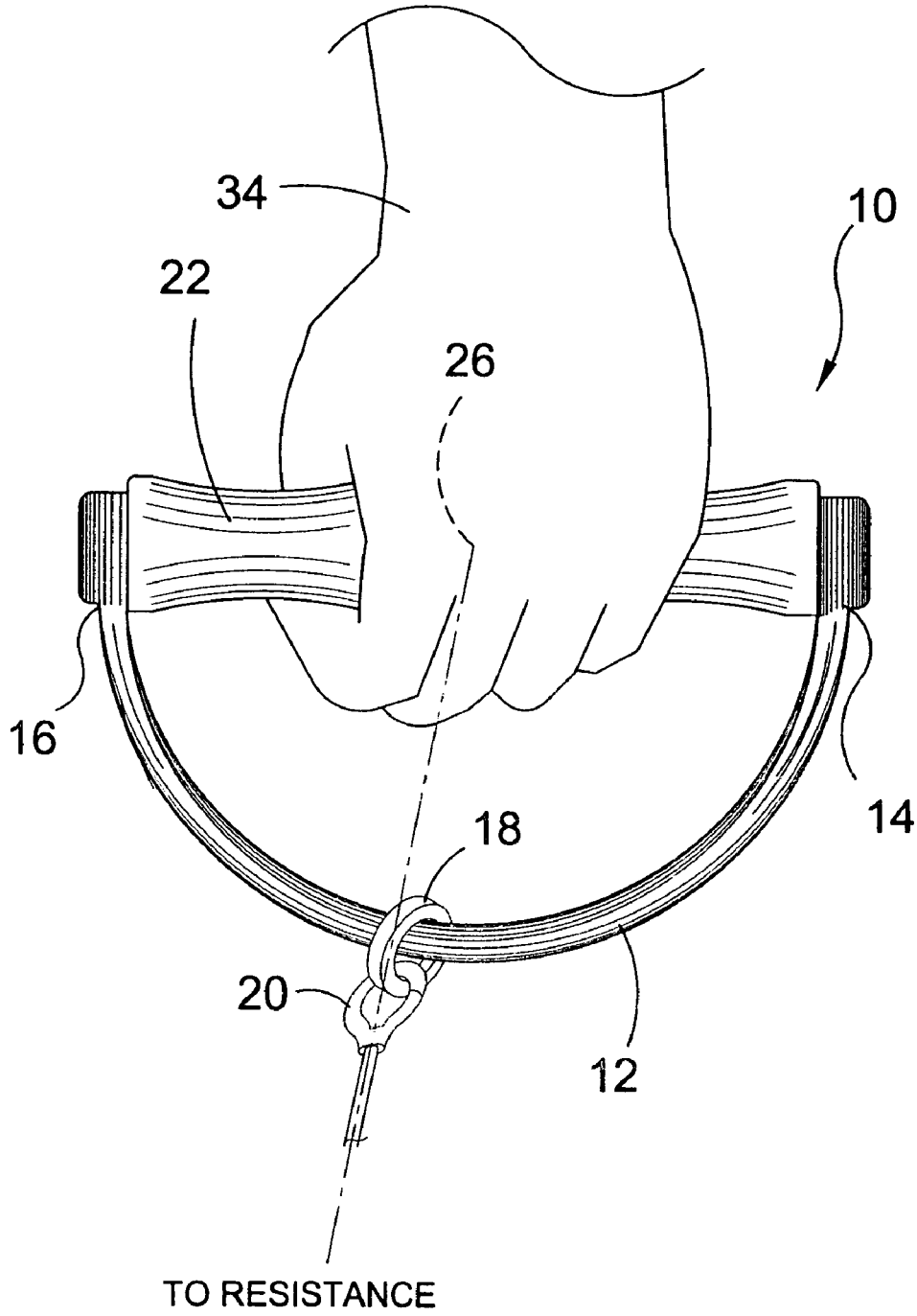
FIG. 2 is a front view of the present invention in use.

FIG. 2 is a frontal view of the present invention in use. Shown is the present invention, an ergonomic exercise handle 10 that allows the user's wrist 34 to automatically adjust itself to its natural alignment with the forearm significantly reducing stress and fatigue. Shown is the handle 10 comprising hand grip 22 fixedly attached between a first end 14 of arcuate member 12 and a second end of arcuate member 12 with the center line 26 of the handle 22 lying on the diameter of arcuate member 12. A cable 20 connected to some form of resistance is attached 18 to the arcuate member 12 with a conventional clip 20 or with a special clip fitted with a small roller 18 to reduce friction.

Figure 3:
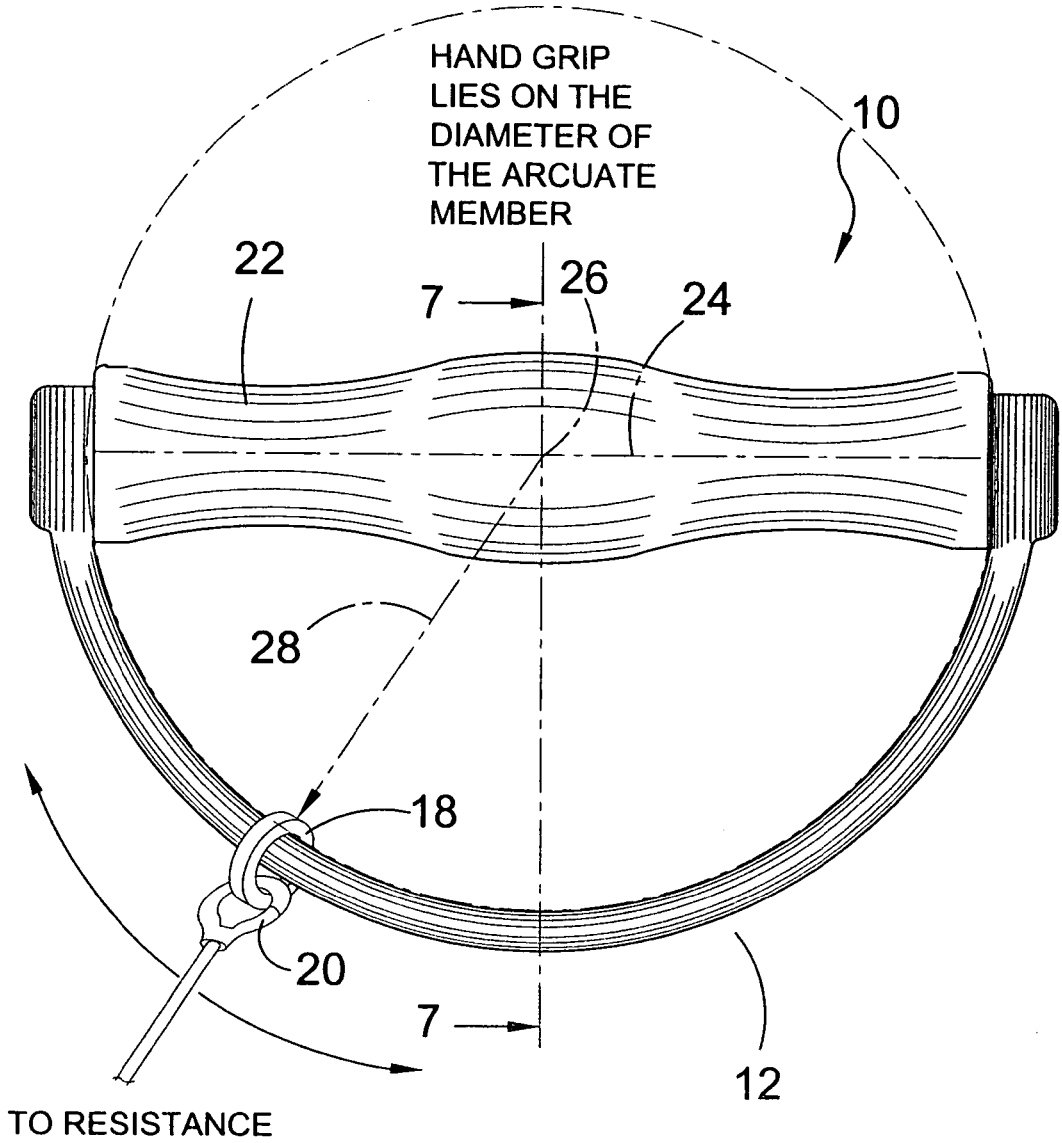
FIG. 3 is a front view of the present invention.

FIG. 3 is a front view of the present invention. Shown is the present invention, an ergonomic exercise handle 10 that allows the user's wrist to automatically adjust itself to its natural alignment with the forearm significantly reducing stress and fatigue. Shown is the handle 10 comprising hand grip 22 and arcuate member 12. Hand grip 22 has a longitudinal center line 24 that also forms the diameter of arcuate member 12 thereby a consistent radius 28 exists between the center 26 of handle 22 and arcuate member 12. When a resistance to attached to the arcuate member 12 by means of clip 20 and slidable member 18 and a force is applied to the resistance through hand grip 22, the arcuate member provides means whereby linear alignment is achieved between the center of hand grip 26 and the resistance through the resulting relocation of slidable member 18 as a result of the applied forces.

Figure 4:
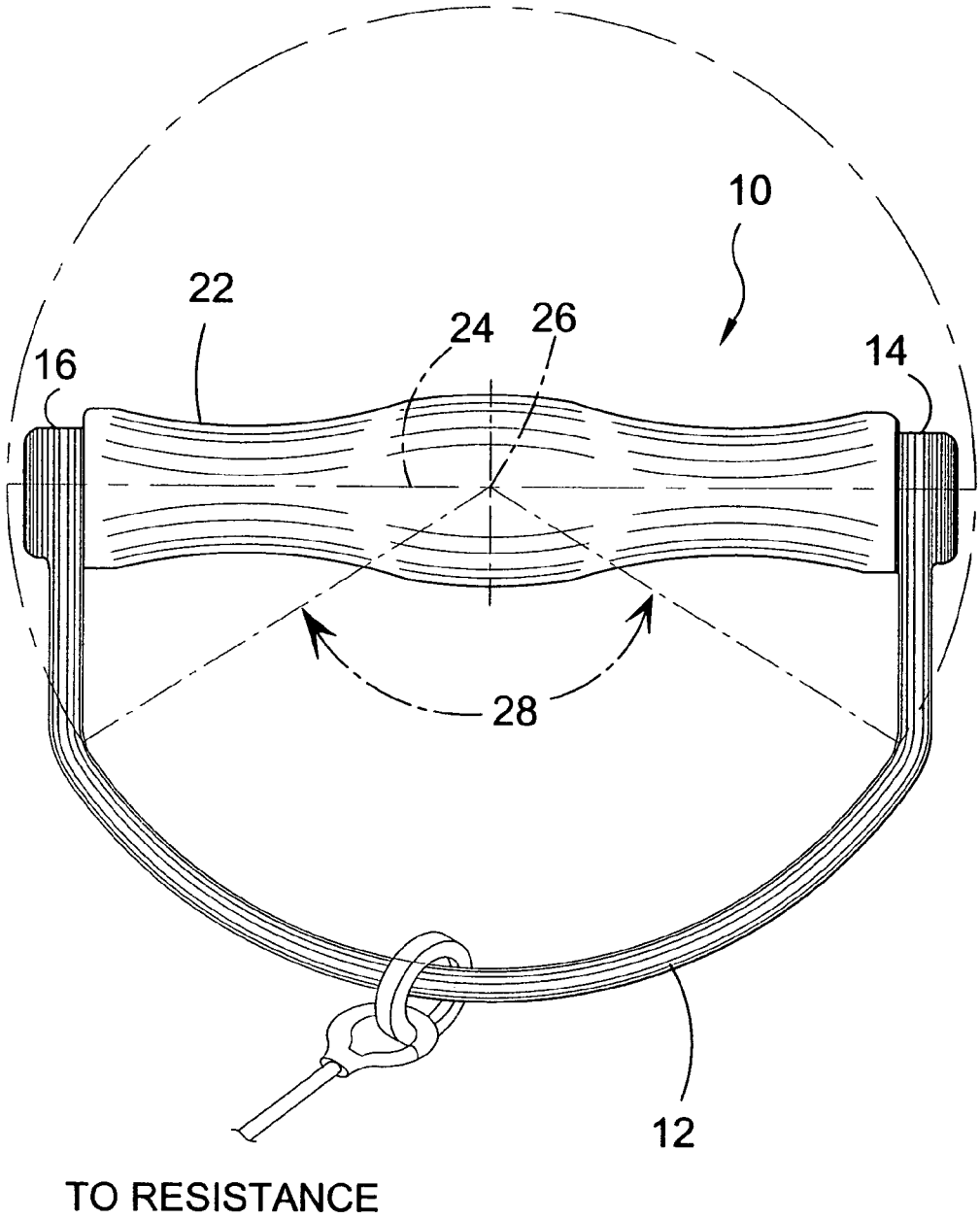
FIG. 4 is an additional element of the present invention.

FIG. 4 is an additional element of the present invention. Shown is the handle 10 comprising hand grip 22 and arcuate member 12 wherein the consistent radii 28 between arcuate member 12 and the center 26 of hand grip 22 is spaced apart form the first end 14 and second end 16 of arcuate member 12 providing for a larger hand area while still maintaining the congruence of the longitudinal center line of hand grip 22 and the diameter of arcuate member 12.

Figure 5:
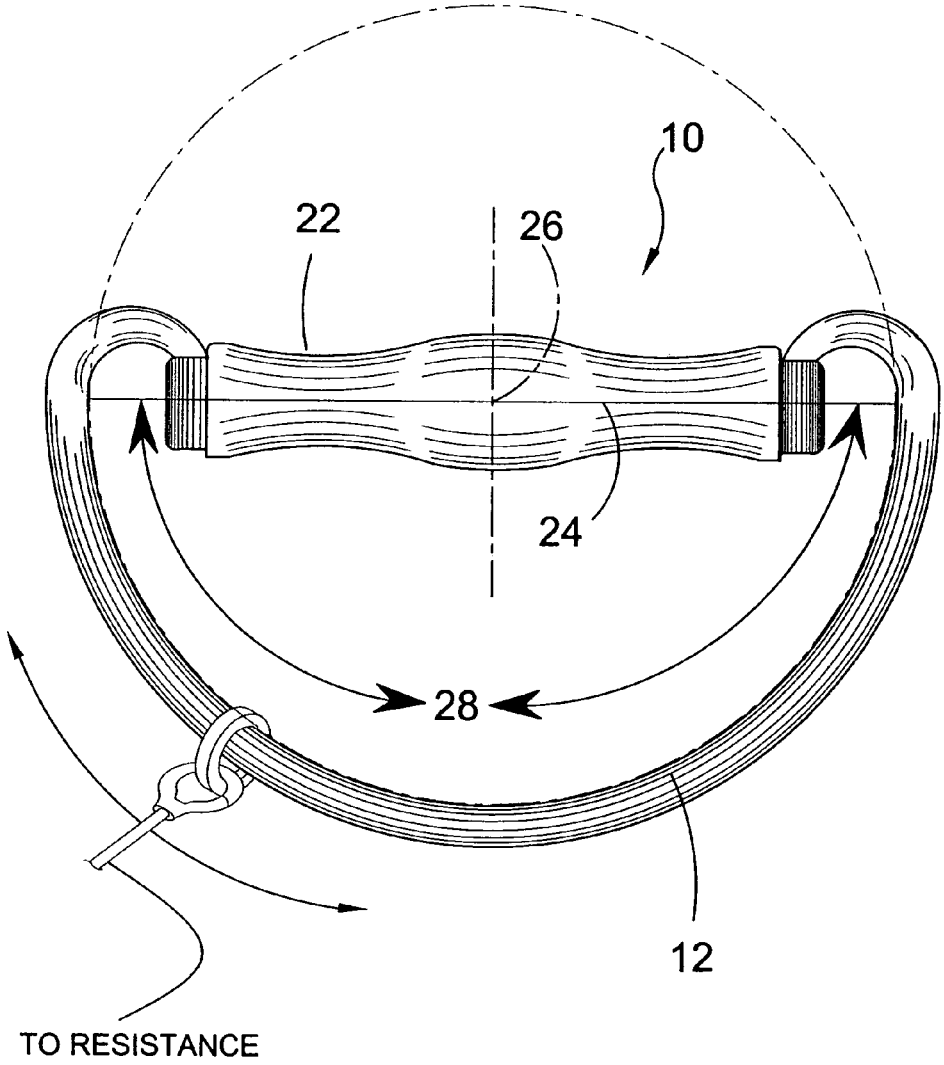
FIG. 5 is an additional element of the present invention.

FIG. 5 is an additional element of the present invention. Shown is another variation of the handle 10 comprising hand grip 22 and arcuate member 12 wherein the consistent radii 28 between arcuate member 12 and the center 26 of hand grip 22 is extended beyond the longitudinal center line 24 of hand grip 22 providing for a greater range of movement while still maintaining the center point of the arcuate member 12 within hand grip 22.

Figure 6:
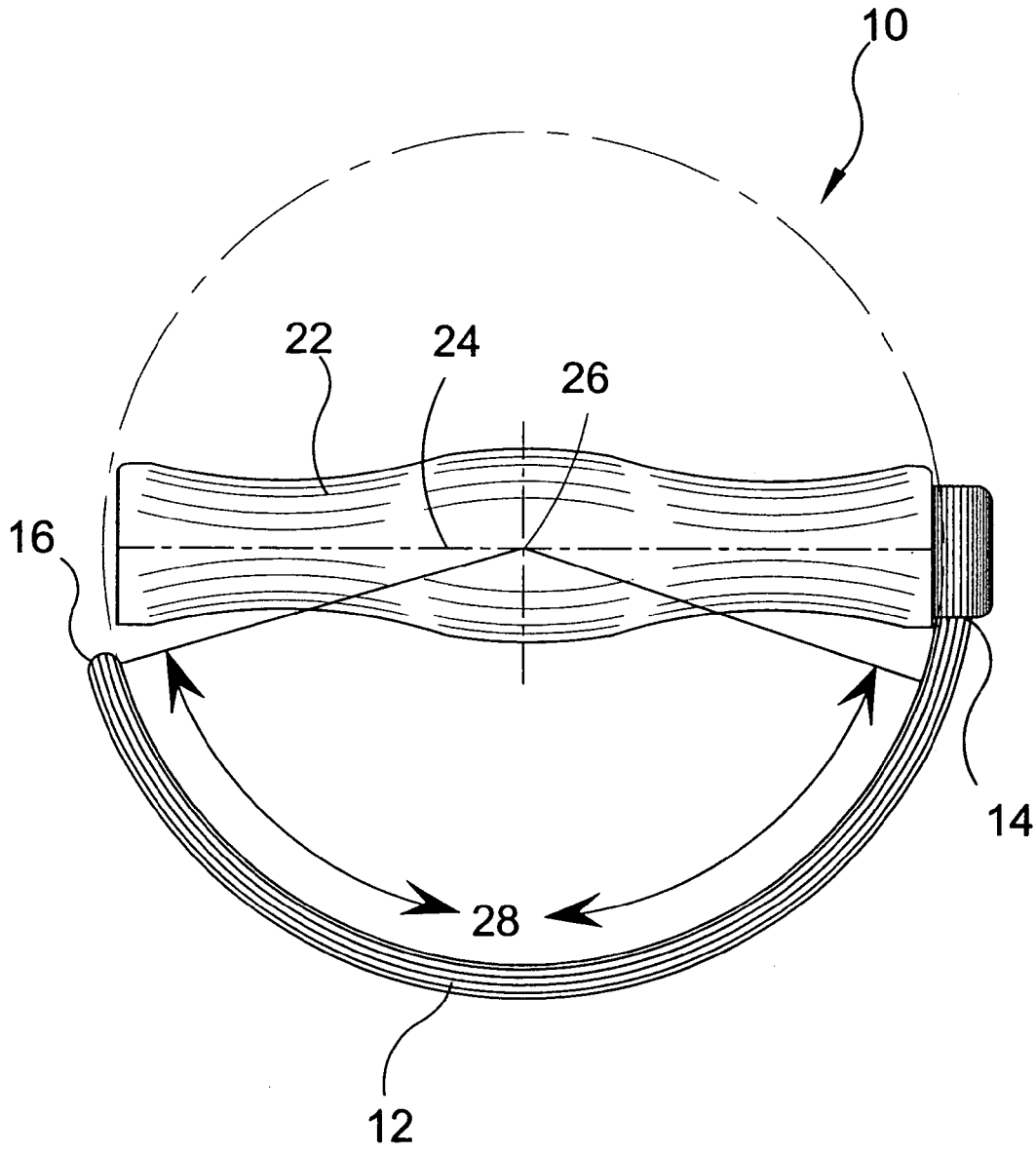
FIG. 6 is an additional element of the present invention.

FIG. 6 is an additional element of the present invention. Shown is another variation of the handle 10 comprising hand grip 22 and arcuate member 12 wherein the first end 14 of arcuate member 12 forms an integral part of hand grip 22 while the second end 16 of arcuate member 12 terminates away from the hand grip 22 providing means for easily attaching one or more fasteners to resistive articles by passing them over the open end of the arcuate member 12, while the consistent radii 28 between arcuate member 12 and the center 26 of hand grip 22 is still positioned at the congruent center of the arcuate member diameter and longitudinal center line of hand grip 22.

Figure 7:
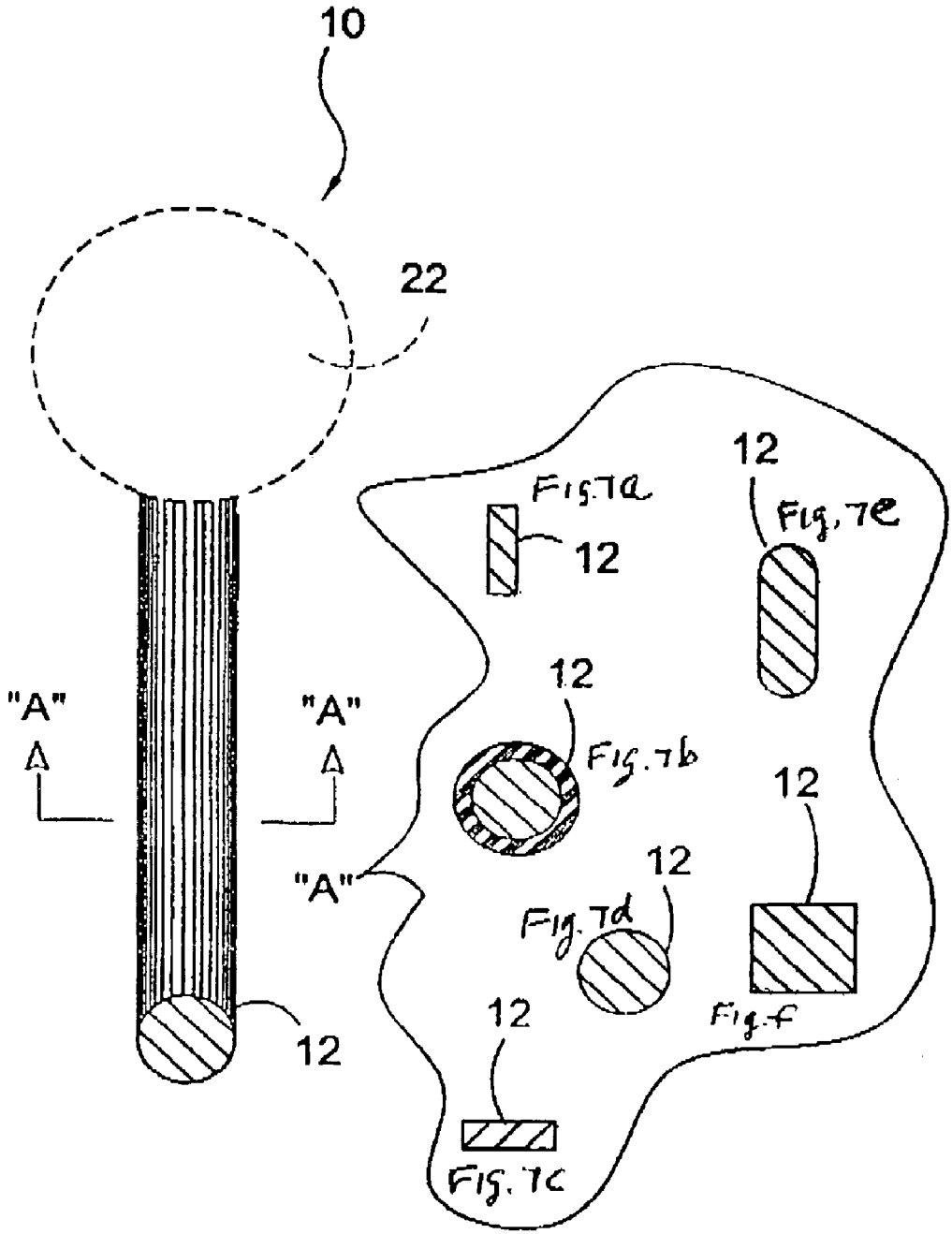

FIG. 7 is a cross sectional view of the present invention, taken from FIG. 3 as indicated showing a cross section of arcuate member 12. While the preferred cross section of the arcuate member is shown as circular, the present invention provides additional shapes that may be advantageous in using the handle 10 of the present invention. It should be noted that the present invention is not limited to these shapes as other shapes may also prove to be advantageous even for purely aesthetic reason and may be comprised of a clad or sheathed arcuate member, as illustrated.

Figure 8:
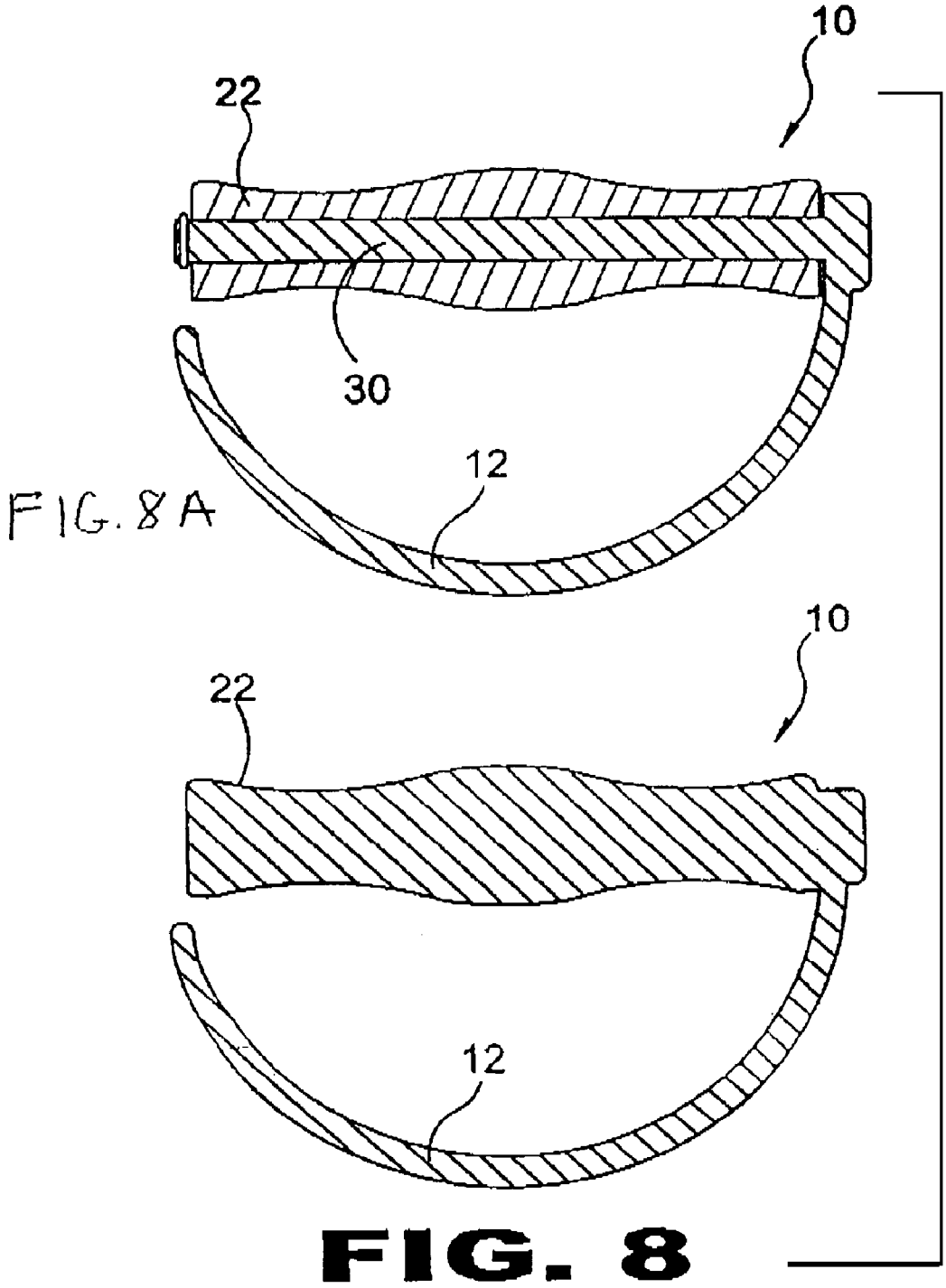

FIG. 8 is an additional element of the present invention. Is a sectional view of the handle 10 of the present invention wherein the hand grip 22 and arcuate member 12 form a unitary handle. Alternately the present invention provides for a shaft-like member 30 extendable in whole or in part into a throughbore of hand grip 22 whereby said hand grip 22 would freely rotate relative to arcuate member 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An ergonomic handle for attachment to a resistance exercise device comprising:

a) a longitudinal hand grip to be held and supported within a user's hand, said hand grip having first and second ends, b) a semicircular, arcuate member extending from said first end of said hand grip to said second end of said hand grip, c) said hand grip having a longitudinal centerline that is substantially positioned on a diameter between said first and second ends of said arcuate member;

d) a slidable member configured to be in communication with a resistive member, said slideable member moveably mounted on said arcuate member wherein when a force is applied to the resistive member by means of said hand grip, said arcuate member permits said slidable member to move to a point on said arcuate member in linear alignment with a center of said hand grip and the resistive member; and e) said first and second ends of said hand grip spaced inwardly along said diameter from said first and second ends, respectively, of said arcuate member, and a pair of loops extending inwardly from said arcuate member past said diameter to join said first and second ends of said hand grip with said first and second ends, respectively, of said arcuate member, said loops providing for a greater range of movement while still maintaining a center point of said arcuate member within said hand grip.

2. The handle as recited in claim 1, wherein said slidable member further comprises an arcuate engaging rotative element to reduce frictional forces.

3. The handle as recited in claim 1, wherein said hand grip is rotative relative to the arcuate member.

4. The handle as recited in claim 1, wherein the hand grip and arcuate member form a single piece.

5. The handle as recited in claim 1, wherein the hand grip is separable from the arcuate member.

6. The handle as recited in claim 1, wherein the arcuate member is clad within a coating material.

7. An ergonomic handle for attachment to a resistance exercise device comprising:

a) a longitudinal hand grip to be held and supported within a user's hand, b) a semicircular arcuate member extending from one end of said hand grip to an opposite end of said hand grip, c) said hand grip having a longitudinal centerline that is substantially positioned on a diameter between ends of said arcuate member;

d) a slidable member configured to be in communication with a resistive member, said slideable member moveably mounted on said arcuate member wherein when a force is applied to the resistive member by means of said hand grip, said arcuate member permits said slidable member to move to a point on said arcuate member in linear alignment with a center of said hand grip and the resistive member; and e) each end of said arcuate member having a circling back portion extending inwardly past said centerline of said hand grip to engage respective ends of said hand grip, said circling back portions substantially entirely within the diameter and on a side of said centerline opposite to that of said arcuate member, thereby providing for a greater range of movement while still maintaining a center point of said arcuate member within said hand grip.

* * * * *